United States Patent [19]

Martini et al.

[11] 4,330,427

[45] May 18, 1982

[54] MIXTURES OF OPTICAL BRIGHTENERS

[75] Inventors: Thomas Martini, Bad Soden am Taunus; Rüdiger Erckel, Eppstein/Taunus; Horst Frühbeis, Kelkheim/Taunus; Günter Rösch, Bad Soden am Taunus; Heinz Probst, Sulzbach, all of Fed. Rep. of Germany

[73] Assignee: Hoechst Aktiengesellschaft, Frankfurt, Fed. Rep. of Germany

[21] Appl. No.: 169,296

[22] Filed: Jul. 16, 1980

[30] Foreign Application Priority Data

Jul. 21, 1979 [DE] Fed. Rep. of Germany ..... 2929687

[51] Int. Cl.[3] ..... C09K 11/06

[52] U.S. Cl. ..... 252/301.24; 252/301.21; 252/301.22; 252/301.25; 252/301.26; 252/301.27; 252/301.28; 252/301.29

[58] Field of Search ..... 252/301.21, 301.22, 252/301.24, 301.25, 301.26, 301.27, 301.29, 301.28

[56] References Cited

U.S. PATENT DOCUMENTS 3,669,896 6/1972 Preininger ..... 252/301.23

OTHER PUBLICATIONS

Yamauchi et al., Chem. Abstracts 83, (1975) #61504c.

*Primary Examiner*—Arthur P. Demers

*Attorney, Agent, or Firm*—Connolly and Hutz

[57] ABSTRACT

Mixtures of optical brighteners consisting of 5 to 95 parts by weight of a mixture consisting of 0 to 80% by weight of the compound of the formula 1

(1)

20 to 100% by weight of the compound of the formula 2

(2)

and 0 to 80% by weight of the compound of the formula 3

(3)

and 95 to 5% by weight of one or more other optical brighteners.

7 Claims, No Drawings

MIXTURES OF OPTICAL BRIGHTENERS

The present invention relates to mixtures of optical brighteners consisting of (A) 0.05 to 0.95 part by weight of a mixture consisting of 0 to 80% by weight of the compound of the formula 1

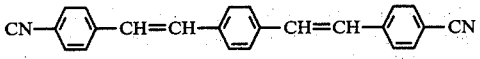

(1)

20 to 100% by weight of the compound of the formula 2

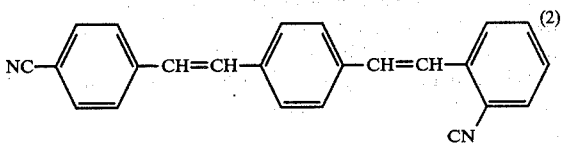

(2)

and 0 to 80% by weight of the compound of the formula 3

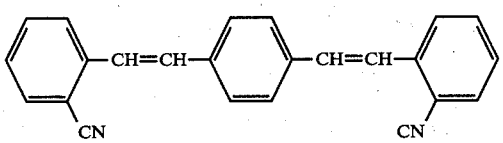

(3)

and (B) 0.95 to 0.05 part by weight of one or more compounds of the formulae 4, 5, 6, 7 or 8

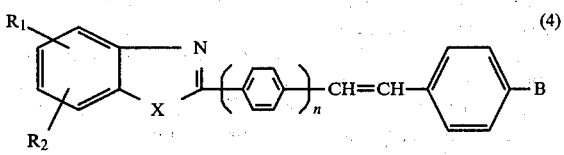

(4)

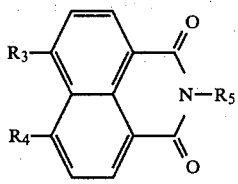

(5)

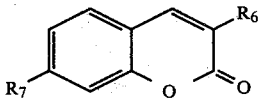

(6)

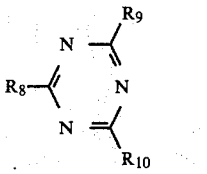

(7)

and

-continued

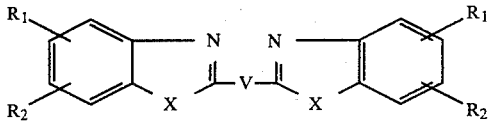

(8)

in which n denotes 0 or 1, X denotes an oxygen or sulfur atom, $R_1$ and $R_2$ denote identical or different radicals from the group comprising hydrogen, fluorine or chlorine atoms, phenyl, trifluoromethyl, $C_1$–$C_9$ alkyl, alkoxy, dialkylamino, acylamino, cyano, carboxyl, carbalkoxy, carboxamide, sulfonic acid, sulfonamide or sulfonic acid alkyl ester, it being possible for two adjacent radicals $R_1$ and $R_2$ together also to represent a benzo ring, a lower alkylene group or a 1,3-dioxapropylene group, B denotes cyano or a group of the formula —$COOR_{11}$ or $CONR_{11}R_{11}$, in which $R_{11}$ denotes hydrogen, $C_1$–$C_{18}$ alkyl, cycloalkyl, aryl, alkylaryl, halogenoaryl, aralkyl, alkoxyalkyl, halogenoalkyl, hydroxyalkyl, alkylaminoalkyl, carboxyalkyl or carboalkoxyalkyl, or two alkyl or alkylene radicals with the meaning of $R_{11}$ can also form, together with the nitrogen atom, a morpholine, piperidine or piperazine ring, or B denotes a group of the formula

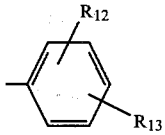

in which $R_{12}$ and $R_{13}$ denote identical or different radicals from the group comprising hydrogen, fluorine or chlorine atoms, phenyl, alkyl, alkoxy, acylamino, cyano, carboxyl, carbalkoxy, carboxamide, sulfonic acid, sulfonamide or sulfonic acid alkyl ester and two adjacent radicals $R_{12}$ and $R_{13}$ together can also represent an alkylene group, a fused benzo ring or a 1,3-dioxapropylene group, or B denotes a group of the formulae

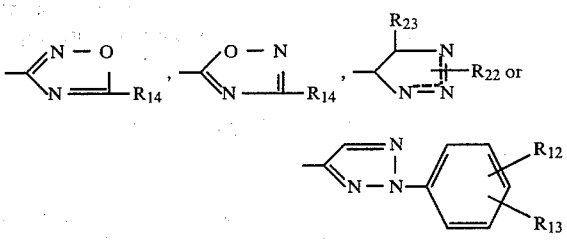

in which $R_{14}$ denotes a straight-chain or branched alkyl group having 1–18 C atoms and preferably 1–6 C atoms, which can be substituted by hydroxyl groups, halogen atoms or alkoxy, dialkylamino, alkylmercapto, chloroaryloxy, aryloxy, arylmercapto or aryl radicals, it being possible, in the case of the dialkylaminoalkyl groups, for the two alkyl groups together also to form a morpholine, piperidine or piperazine ring, or $R_{14}$ denotes a group of the formula —$(CH_2CH_2O)_n$—R in which n is 1, 2 or 3 and R is H, alkyl, dialkylaminoalkoxyalkyl or alkylthioalkoxyalkyl, it being possible for the dialkyl groups in dialkylaminoalkoxyalkyl together to form a piperidine, pyrrolidine, hexamethyleneimine, morpholine or piperazine ring, or $R_{14}$ denotes a radical of the formula

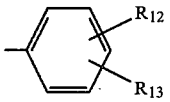

$R_{22}$ denotes a hydrogen atom, a triphenylmethyl group or a lower alkyl radical, which is optionally substituted by a lower carbalkoxy, carboxamido, mono- or di-alkylcarboxamido, carboxyl or benzoyl group, and $R_{23}$ denotes a cyano group or a group of the formulae

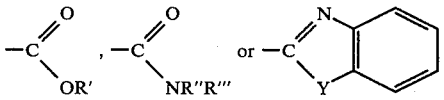

in which R', R'' and R''' denote a hydrogen atom, a lower alkyl radical or a phenyl radical, and it being possible for the lower alkyl radicals to be substituted by hydroxyl, lower alkoxy, lower dialkylamino or lower trialkylammonium groups and for the phenyl group to be substituted by halogen atoms or lower alkyl or lower alkoxy groups, and in which R'' and R''' together can also form a saturated, divalent radical, and Y denotes O, S or N—R, in which R is H or ($C_1$ to $C_4$)-alkyl, or B denotes a group of the formula

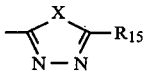

in which $R_{15}$ denotes a phenyl ring which can be substituted by one or two chlorine atoms, one or two alkyl or alkoxyalkyl groups or one phenyl, cyano, carboxyl, carbalkoxy, carboxamide, sulfonic acid, sulfonamide or sulfonic acid alkyl ester group, $R_3$ and $R_4$ can be identical or different and denote hydrogen, alkyl, cycloalkyl, alkoxy, hydroxyalkoxyethyl, halogenoalkyl, aralkyl, aryl or N,N-di-alkylamine, or $R_3$ and $R_4$ together form a five-membered heterocyclic radical having 1 to 3 heteroatoms, preferably N atoms, $R_5$ denotes straight-chain or branched alkyl, alkoxyalkyl, dialkylaminoalkyl or a radical of the formula

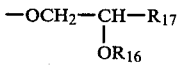

in which $R_{16}$ is hydrogen, $C_2$–$C_8$-alkanoyl, benzoyl or a radical of the formula $R_{18}NHCO$— or $R_{19}OCO$— and $R_{17}$ is hydrogen, alkyl or phenyl, $R_{18}$ is alkyl, phenyl, halogenophenyl or tolyl and $R_{19}$ is $C_1$–$C_8$-alkyl, alkoxyalkyl, cyclohexyl, benzyl, phenylethyl or phenyl which is optionally substituted by non-chromophoric substituents, or $R_5$ denotes a radical of the formula

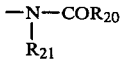

in which $R_{20}$ is $C_1$–$C_{10}$-alkyl, $C_2$–$C_6$-alkenyl, $C_2$–$C_6$-alkinyl, $C_1$–$C_8$-alkoxy, $C_1$–$C_8$-alkylamino or dialkylamino, phenoxymethyl, phenyl, tolyl, benzyl or phenylethyl and $R_{21}$ is $C_3$–$C_{10}$-alkyl, which can be substituted by phenyl, hydroxyphenyl, methoxy or dimethoxy, $R_6$ denotes an aryl radical, which is optionally substituted by non-chromophoric substituents, or denotes a 1,2,4-triazol-1-yl-phenyl, 1,2,3-triazol-4-yl-phenyl, 1,2,3-triazol-3-yl-phenyl or 1,2,3-triazol-2-yl-phenyl radical, which optionally can be substituted by 1 or 2 $C_1$–$C_3$-alkyl or oxalkyl groups or by oxaryl, oxalkenyl or oxalkanoyl, or $R_6$ denotes a heterocyclic ring having 1–3 heteroatoms, preferably N or O, which can be substituted by alkyl, alkoxy, halogen, aryl or halogenoaryl, or $R_6$ denotes a 1-oxa-2,4-diazol-5-yl radical, which can be substituted by benzyl, alkoxyphenyl, styryl, halogen, alkoxy or a further heterocyclic group, or $R_6$ denotes a benzimidazol-1-yl, benzimidazol-2-yl, benzthiazol-1-yl or benzthiazol-2-yl radical, which can be substituted by non-chromophoric substituents, $R_7$ denotes hydrogen, alkyl, alkoxy, aryl or a five-membered heterocyclic radical which has 1–3 N or O hetero-atoms and is bonded via a nitrogen atom and can be substituted by alkyl, aryl, hydroxyl, oxalkyl, oxalkenyl, oxaryl, oxarylalkyl, oxalkoxycarbonyl, oxcarbamoyl, oxepoxyalkyl, styryl or halogenostyryl, a fused phenyl, naphthyl or phenanthryl ring or a fused group of the formulae

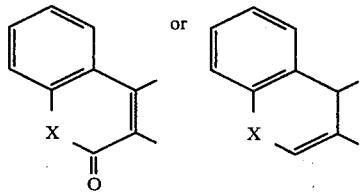

and the aromatic rings in the fused groups can also be substituted by alkyl or alkoxy and X is oxygen, NH or N-alkyl, $R_8$ represents a polycyclic, aromatic radical having at least three fused rings, which optionally carry non-chromophoric substituents, $R_9$ represents an amino group, which is substituted by one or two alkyl, hydroxyalkyl, acyl or phenyl groups, it being possible for the phenyl group to contain one or more non-chromophoric radicals and for two alkyl groups, together with the nitrogen atom of the amino group, to form a pyrrolidine or piperidine ring or, with the inclusion of a further nitrogen or oxygen atom, a piperazine or morpholine ring, or $R_9$ represents an alkoxy, hydroxyalkoxy, acyloxy, alkylthio or carbalkylmercapto group, $R_{10}$ independently of $R_8$ has the same meaning as $R_9$ and in addition can denote a chlorine atom and V denotes a group of the formulae

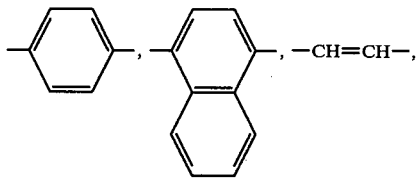

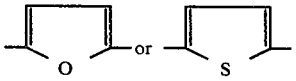

Unless defined otherwise, alkyl and alkoxy groups and also other groups derived therefrom contain 1 to 4 C atoms. The term "non-chromophoric substituents" is to be understood as meaning alkyl, alkoxy, aryl, aralkyl, trifluoromethyl, cycloalkyl, halogen, alkylsulfonyl, carboxyl, sulfonic acid, cyano, carboxamide, sulfonamide, carboxylic acid alkyl ester and sulfonic acid alkyl ester.

Preferred mixtures, according to the invention, of optical brighteners are those in which component B consists of one or more compounds of the formulae 2b–6b

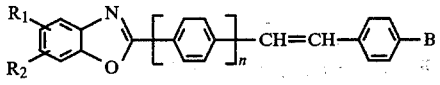

(2b)

in which $R_1$ in the 5-position denotes a hydrogen or chlorine atom or a methyl or phenyl group and $R_2$ denotes a hydrogen atom, or $R_1$ and $R_2$ both denote a methyl group in the 5,6- or 5,7-position, n denotes 0 or 1 and B denotes a cyano or carbo-($C_1$–$C_4$)-alkoxy group or a group of the formulae

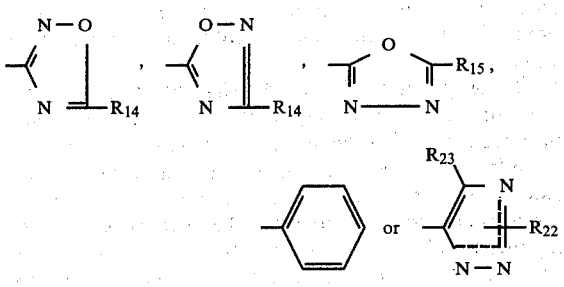

in which $R_{14}$ denotes ($C_1$–$C_6$)-alkyl, ($C_1$–$C_6$)-chloroalkyl, ($C_1$–$C_4$)-alkoxy-($C_1$–$C_4$)-alkyl, hydroxy-($C_1$–$C_4$)-alkyl or a group of the formula —$(CH_2CH_2O)_n$—R, n denotes 2 or 3 and R denotes hydrogen or ($C_1$–$C_4$)-alkyl, $R_{15}$ denotes phenyl, halogenophenyl, ($C_1$–$C_4$)-alkylphenyl or ($C_1$–$C_4$)-alkoxyphenyl, $R_{22}$ denotes ($C_1$–$C_4$)-alkyl and $R_{23}$ denotes cyano or carbo-($C_1$–$C_4$)-alkoxy,

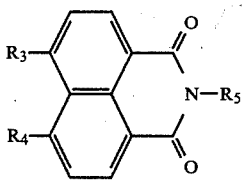

(3b)

in which $R_3$ denotes hydrogen or ($C_1$–$C_4$)-alkoxy, $R_4$ denotes ($C_1$–$C_4$)-alkoxy and $R_5$ denotes ($C_1$–$C_6$)-alkyl or ($C_1$–$C_4$)-alkoxy-($C_1$–$C_4$)-alkyl,

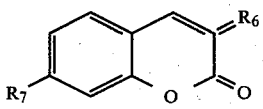

(4b)

in which $R_6$ denotes phenyl or the group of the formulae

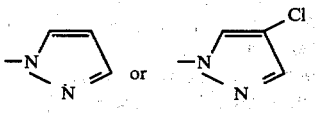

and $R_7$ denotes a group of the formula

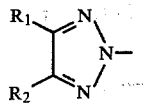

in which $R_1$ represents hydrogen or ($C_1$–$C_4$)-alkyl and $R_2$ represents phenyl or ($C_1$–$C_4$)-alkoxy, or $R_1$ and $R_2$ together represent a benzo or (1,2-d)-naphtho ring,

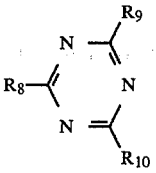

(5b)

in which $R_8$ denotes a pyrenyl group and $R_9$ and $R_{10}$ denote ($C_1$–$C_4$)-alkoxy, and

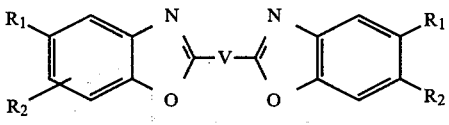

(6b)

in which $R_1$ and $R_2$ have the same meaning as in formula 2b and V denotes a group of the formulae

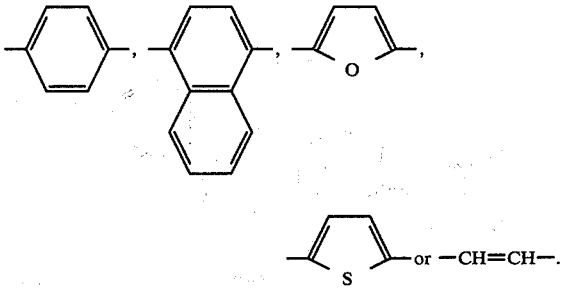

Further preferred mixtures, according to the invention, of optical brighteners are those in which component B consists of one or more compounds of the following formulae:

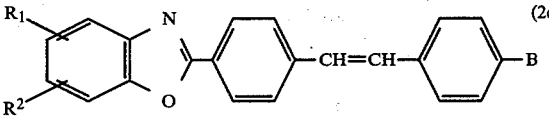

(2c)

in which $R_1$ and $R_2$ in the 5,6-position are methyl and B is carbomethoxy, or $R_1$ is hydrogen, $R_2$ is hydrogen or methyl in the 5-position and B is carbomethoxy, cyano or a group of the formulae

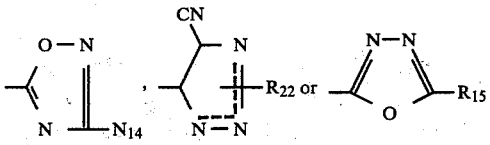

in which $R_{14}$ and $R_{22}$ are ($C_1$–$C_3$)-alkyl and $R_{15}$ is phenyl, 4-methylphenyl or 4-methoxyphenyl, or $R_1$ is hydrogen, methyl or t-butyl in the 5-position, $R_2$ is hydrogen or methyl in the 7-position and B is phenyl, (3c)

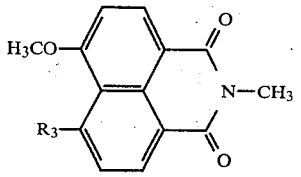

in which $R_3$ is hydrogen or methoxy, (4c)

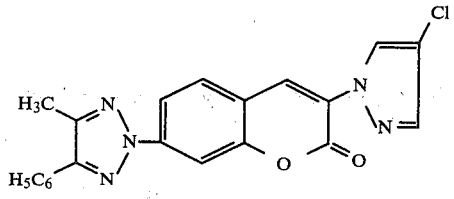

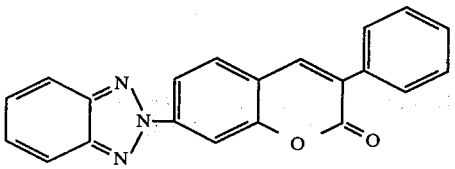

or

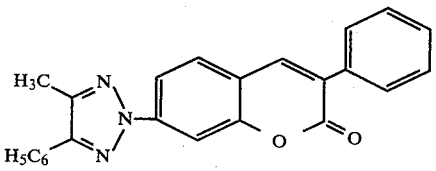

(5c)

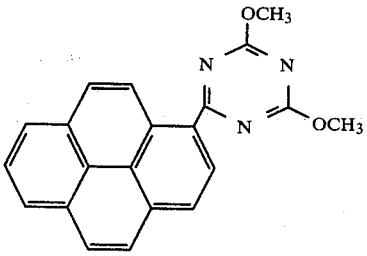

and (6c)

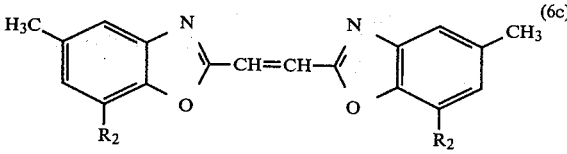

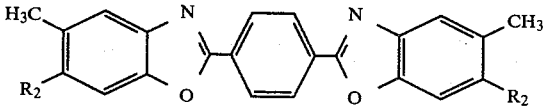

or

-continued

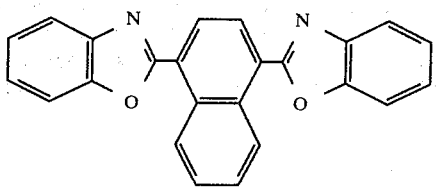

in which $R_2$ is hydrogen or methyl.

Mixtures of the following composition are preferred as component A, comprising the compounds of the formulae 1–3: 5 to 35% by weight of compound 1, 30 to 90% by weight of compound 2 and 5 to 35% by weight of compound 3.

Mixtures of the following composition are particularly preferred as component A: 15 to 28% by weight of compound 1, 44 to 70% by weight of compound 2 and 15 to 28% by weight of compound 3, and the proportions of compounds 1 and 3 should be approximately equal.

The proportions of the individual compounds 1 to 3 in component A can vary within the indicated limits, preferred mixtures being those which contain compounds 1 and 3 in approximately equal proportions. It can be seen from the limits given above for the weight ratios of compounds 1 to 3 that the proportions of compounds 1 and 3 can be 0% and the proportion of compound 2 can be 100%. In this case, compound 2 is present as the pure compound. It will be understood that the composition of component A will be so chosen within the diverse limits indicated above that the sum of all of the individual compounds makes up 100%.

The mixture which is designated component A is prepared by reacting 1 mole equivalent of a compound of the formula (9)

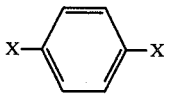

with a total of 2 mole equivalents of a mixture of the compounds (10)

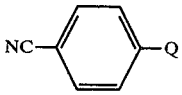

and (11)

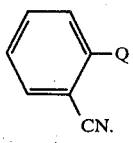

The ratio of compounds 10 and 11 determines the composition of the mixture. If the proportion of 10 is higher, the proportion of compound 1 increases at the expense of compound 3, and if the proportion of compound 11 is higher, the proportion of compound 3 in the mixtures will be higher than that of compound 1.

It is advantageous to carry out the reaction of 9 with one mole equivalent of each of the compounds 10 and 11; an excess of 10 and 11 of up to 10% is possible but is of no advantage. In the formulae 9–10, one of the symbols X or Q denotes an aldehyde group and the other symbol denotes a group of the formulae

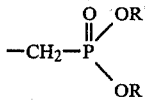
(12a)

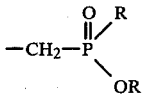
(12b)

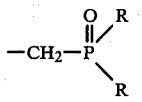
(12c)

or

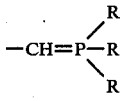
(12d)

in which R represents an optionally substituted alkyl radical having, preferably, 1–6 C atoms, an aryl radical, preferably phenyl, a cycloalkyl radical or an aralkyl radical, preferably benzyl.

A preferred process variant comprises reacting a compound of the formula 9 in which X represents an aldehyde group with compounds of the formula 10 and 11 in which Q represents a group of the formula 12a in which R is $C_{1-4}$ alkyl.

The process is preferably carried out in solvents, in the presence of a proton acceptor. Solvents which may be mentioned are, for example, hydrocarbons, such as toluene and xylene, alcohols, such as methanol, ethanol, isopropanol, butanol, glycols, hexanols and cyclohexanols, and also ethers, such as diisopropyl ether, tetrahydrofuran, dioxan and dimethylsulfoxide. Particularly suitable solvents are polar organic solvents such as formamide, dimethylformamide and N-methylpyrrolidone, and dimethylformamide is to be singled out in particular.

Suitable proton acceptors are, in the main, basic compounds, such as alkali metal hydroxides, alcoholates or amides or alkaline earth metal hydroxides, alcoholates or amides, strongly basic amines and anion exchange resins in the hydroxyl form. The use of alkali metal hydroxides, in particular potassium hydroxide, is preferred.

The reaction temperature depends on the nature of the components to be reacted and in particular on the nature of the organic compound containing carbonyl groups and on the proton acceptor; it is between −10° C. and +100° C. and advantageously between 0° and 50° C. A preferred embodiment comprises adding the reactants to one another at relatively low temperatures and bringing the reaction to completion at a higher temperature.

The process claimed can, for example, by carried out by initially introducing the proton acceptor in the solvent and adding dropwise a solution of the reactants 9–11 in the solvent, but it is also possible initially to introduce the compounds 9–11 and to add the proton acceptors. A further embodiment comprises initially introducing the compounds 9–11, in which X or Q represents a group of the formula 12a–d, and then adding first the proton acceptor and then the aldehyde component. The reaction in general proceeds with vigorous evolution of heat, so that the reaction mixture has to be cooled if necessary. The reaction mixture is worked up in a known manner, for example by adding methanol or ethanol and separating off the products which have precipitated. The product mixtures obtained in this way can be analyzed and characterized by HPLC (high pressure liquid chromatography).

The starting compounds of the formulae 9–11 are known or can be prepared by known processes.

Of the compounds covered by formulae 4 to 8, the compounds of the following formulae are preferred in the mixtures according to the invention:

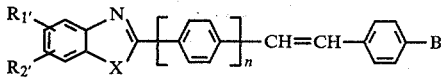

in which $R_{1'}$ and $R_{2'}$ in the 5-position and 7-position denote hydrogen or chlorine, alkyl or phenyl or together denote a fused phenyl ring, X denotes oxygen or sulfur, n denotes 1 and B denotes a group of the formulae

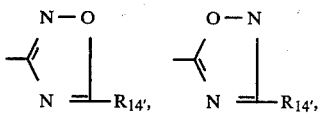

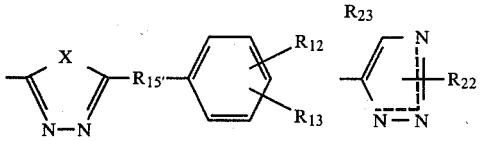

or

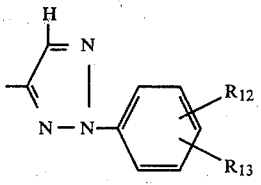

in which $R_{14'}$ denotes alkyl, chloroalkyl, alkoxyalkyl, hydroxyalkyl or a group of the formula $-(CH_2CH_2O)_n-R$, in which n is 2 or 3 and R is hydrogen or alkyl, $R_{15}$ denotes phenyl, which can be substituted by one or two chlorine atoms, one or two alkyl or alkoxyalkyl groups or one phenyl, cyano, carboxylic acid, carbalkoxy, carboxamide, sulfonic acid, sulfonamide or sulfonic acid alkyl ester group, $R_{23}$ denotes cyano or carbalkoxy and $R_{22}$ denotes alkyl.

Formula 5:

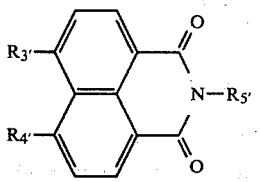

in which $R_{3'}$ denotes hydrogen or alkoxy, $R_{4'}$ denotes alkoxy and $R_{5'}$ denotes alkyl, alkoxyalkyl or dialkylaminoalkyl.

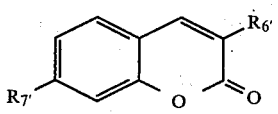

in which $R_{6'}$ denotes phenyl or the group of the formula

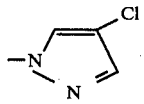

and $R_{7'}$ denotes the groups of the formulae

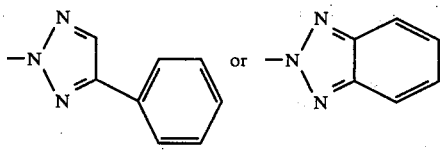

Formula 7:

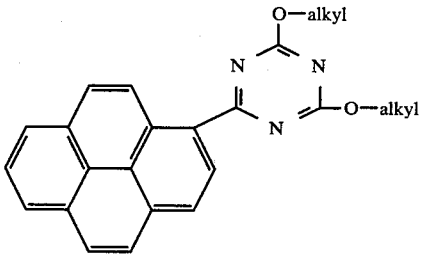

Formula: 8

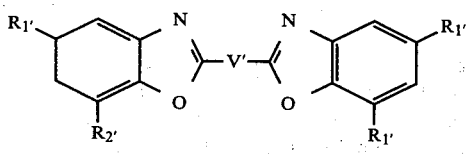

in which $R_{1'}$ and $R_{2'}$ denote hydrogen or alkyl and V' denotes a group of the formulae

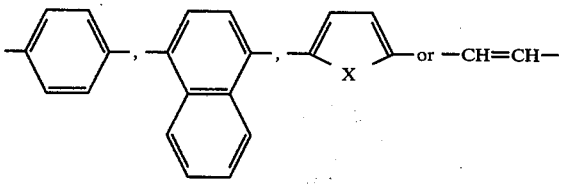

and X denotes O or S.

Of the compounds covered by formula 4, very particularly preferred compounds are those of the formula

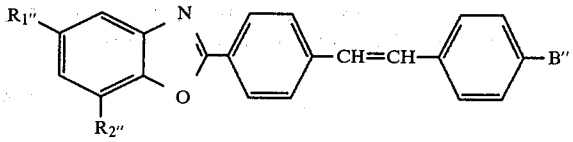

in which $R_{1''}$ and $R_{2''}$ denote hydrogen or alkyl and B'' denotes a group of the formulae

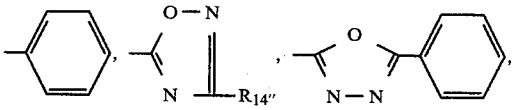

—CN or —COOalkyl, and $R_{14''}$ denotes alkyl or methoxyethyl. The following compounds covered by formula 4 are of particular importance:

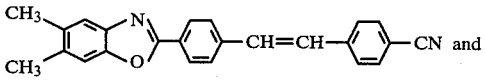

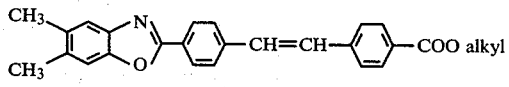

The mixing ratio of the individual components is between 0.05 and 0.95 parts by weight of component A and, correspondingly, 0.95 to 0.05 parts by weight of the other compounds of the formulae 4 to 8. These compounds of the formulae 4 to 8 can be employed on their own or can also be employed in any desired mixture with one another; the mixing ratio of these compounds with one another is entirely non-critical and can be varied as desired.

A mixing ratio of 5 to 50% by weight of component A and 95 to 50% by weight of one or more brighteners of the formulae 4 to 8 (component B) is preferred.

In an individual case, the optimum mixing ratio of all compounds depends on the structure of the particular compounds and can be determined without difficulty by simple preliminary experiments.

As is customary in the case of optical brighteners, the individual components are brought into a commercial form by dispersing in a liquid medium, for example water. The individual components can each be dispersed on their own and these dispersions can then be added together. However, the individual components can also be mixed with one another in the solid form and then dispersed together. This dispersing process is effected in a conventional manner in ball mills, colloid mills, bead mills or dispersion kneaders. The mixtures according to the invention are particularly suitable for brightening textile material made of linear polyesters, polyamides and acetylcellulose. However, these mixtures can also be used with good result on mixed fabrics which consist of linear polyesters and other synthetic or natural fiber materials, specifically fibers containing hydroxyl groups and in particular cotton. These mixtures are applied under the conditions customary for the use of optical brighteners, such as, for example, by the exhaustion process at 90° C. to 130° C. with or without the addition of accelerators (carriers) or by the thermosol process. The brighteners which are insoluble in water and the mixtures according to the invention can also be used in the form of a solution in organic solvents, for example perchloroethylene or fluorinated hydrocarbons. The textile material can be treated by the exhaustion process with the solvent liquor which contains the optical brightener in solution, or the textile material is impregnated, padded or sprayed with the solvent liquor containing the brightener and is then dried at temperatures of 120°–220° C., during which operation all of the optical brightener is fixed in the fiber. Outstandingly brightened goods are obtained which have excellent stability to light and also stability to oxidizing agents and reducing agents. Compared with the mixtures of Japanese Patent Sho 50(1975)-25,877, these mixtures according to the invention have greater whiteness; furthermore, they also give outstanding whiteness even at low thermosol temperatures of, for example, 150° C.

The following tabulated examples illustrate the invention. The application process employed is described here by way of example.

Cut pieces of a fabric of polyester staple fibers are washed and dried and impregnated on a padder with aqueous dispersions which contain either the pure optical brightener of the formulae 4 to 8 (component B), the amount used being 0.08% by weight, or a mixture of 0.064% by weight, 0.04% by weight or 0.016% by weight of component A with 0.016, 0.04 or 0.064% by weight respectively of the brighteners of component B. In all of the examples a mixture of 1.5 parts by weight of 1,4-bis-(4'-cyano-styryl)-benzene, 1.5 parts by weight of 1,4-bis-(2'-cyano-styryl)-benzene and 7 parts by weight of 1-(2-cyano-styryl)-4-(4'-cyano-styryl)-benzene was employed as component A.

The material is squeezed off between rollers using a padder so that the wet pick-up is about 80%. This corresponds to a pick-up of optical brighteners on the goods of 0.064%. The material padded in this way was then subjected to a thermosol treatment on a tenter frame for 30 seconds at 170° (Table I) or 210° (Table II). The Ganz whiteness values indicated in each case were obtained. The whiteness was measured using a type DMC-25 reflectance spectrophotometer (Messrs. Carl Zeiss, Oberkochen).

TABLE I

| Component B | Amount of component A used | Amount of component B used | Ganz whiteness |
|---|---|---|---|
| 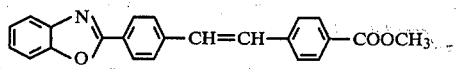 | — | 0.08 | 206 |
| " | 0.064 | 0.016 | 239 |
| " | 0.04 | 0.04 | 239 |
| " | 0.016 | 0.064 | 237 |
| 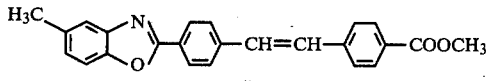 | — | 0.08 | 213 |
| " | 0.064 | 0.016 | 239 |
| " | 0.04 | 0.04 | 237 |
| " | 0.016 | 0.64 | 232 |
| 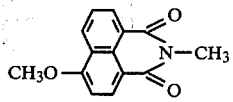 | — | 0.08 | 189 |
| " | 0.064 | 0.016 | 232 |
| " | 0.04 | 0.04 | 231 |
| | 0.016 | 0.064 | 222 |
| 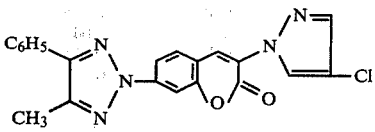 | — | 0.08 | 203 |
| " | 0.064 | 0.016 | 226 |
| " | 0.04 | 0.04 | 223 |
| " | 0.016 | 0.064 | 214 |
| 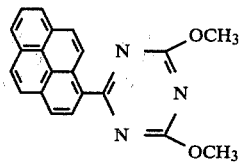 | — | 0.08 | 244 |
| " | 0.064 | 0.016 | 237 |
| " | 0.04 | 0.04 | 238 |
| " | 0.016 | 0.064 | 242 |
| 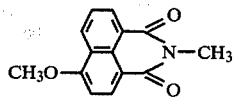 | — | 0.08 | 191 |
| " | 0.064 | 0.016 | 230 |
| " | 0.04 | 0.04 | 228 |
| " | 0.016 | 0.064 | 224 |

TABLE I-continued
| Component B | Amount of component A used | Amount of component B used | Ganz whiteness |
|---|---|---|---|
| 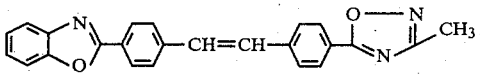 | — | 0.08 | 215 |
| " | 0.064 | 0.016 | 237 |
| " | 0.04 | 0.04 | 233 |
| " | 0.016 | 0.064 | 235 |
| 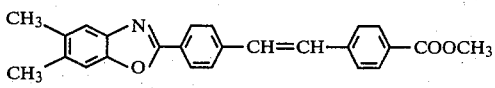 | — | 0.08 | 207 |
| " | 0.064 | 0.016 | 236 |
| " | 0.04 | 0.04 | 239 |
| " | 0.016 | 0.64 | 232 |
TABLE II
| Component B | Amount of component A used | Amount of component B used | Ganz whiteness |
|---|---|---|---|
| 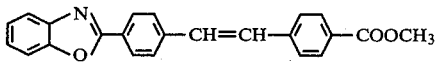 | — | 0.08 | 212 |
| " | 0.064 | 0.016 | 244 |
| " | 0.04 | 0.04 | 240 |
| " | 0.016 | 0.064 | 235 |
| 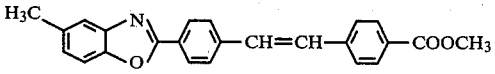 | — | 0.08 | 221 |
| " | 0.064 | 0.016 | 243 |
| " | 0.04 | 0.04 | 245 |
| " | 0.016 | 0.64 | 236 |
| 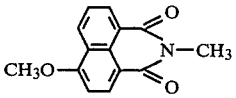 | — | 0.08 | 197 |
| " | 0.064 | 0.016 | 238 |
| " | 0.04 | 0.04 | 233 |
| " | 0.016 | 0.064 | 225 |
| 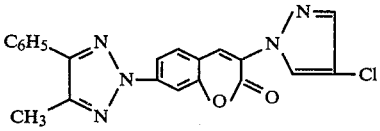 | — | 0.08 | 206 |
| " | 0.064 | 0.016 | 234 |
| " | 0.04 | 0.04 | 226 |
| " | 0.016 | 0.064 | 214 |
| 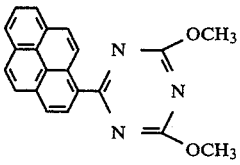 | — | 0.08 | 204 |
| " | 0.064 | 0.016 | 230 |
| " | 0.04 | 0.04 | 221 |
| " | 0.016 | 0.064 | 210 |
| 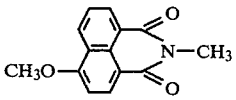 | — | 0.08 | 193 |
| " | 0.064 | 0.016 | 236 |
| " | 0.04 | 0.04 | 232 |
| " | 0.016 | 0.064 | 225 |
| 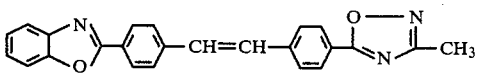 | — | 0.08 | 231 |
| " | 0.064 | 0.016 | 242 |
| " | 0.04 | 0.04 | 244 |
| " | 0.016 | 0.064 | 243 |

TABLE II-continued

| Component B | Amount of component A used | Amount of component B used | Ganz whiteness |
|---|---|---|---|
| 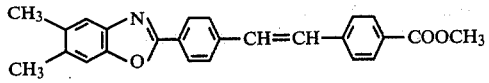 | — | 0.08 | 207 |
| " | 0.064 | 0.016 | 239 |
| " | 0.04 | 0.04 | 234 |
| " | 0.016 | 0.64 | 227 |

We claim:

1. Mixtures of optical brighteners consisting of (A) 0.05 to 0.95 part by weight of a mixture consisting of 0 to 80% by weight of the compound of the formula 1

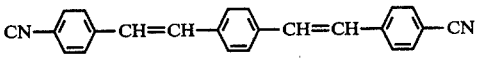

(1)

20 to 100% by weight of the compound of the formula 2

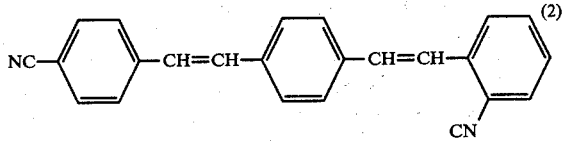

(2)

and 0 to 80% by weight of the compound of the formula 3

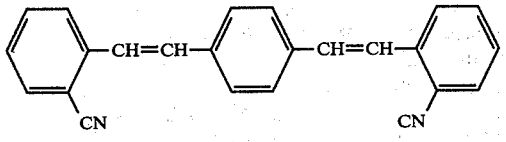

(3)

and (B) 0.95 to 0.05 part by weight of one or more compounds of the formulae 4, 5, 6, 7 or 8

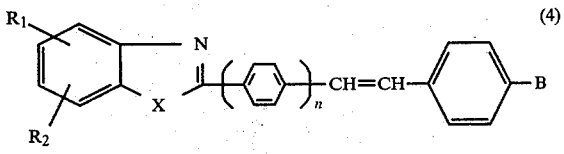

(4)

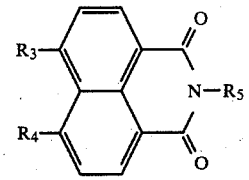

(5)

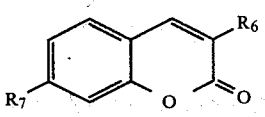

(6)

-continued

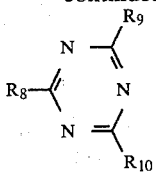

(7)

and

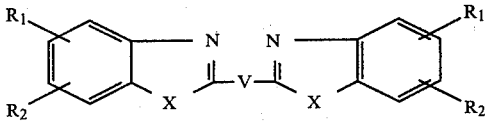

(8)

in which n denotes 0 or 1, X denotes an oxygen or sulfur atom, $R_1$ and $R_2$ denotes identical or different radicals from the group comprising hydrogen, fluorine or chlorine atoms, phenyl, trifluoromethyl, $C_1$–$C_9$ alkyl, alkoxy, dialkylamino, acylamino, cyano, carboxyl, carbalkoxy, carboxamide, sulfonic acid, sulfonamide or sulfonic acid alkyl ester, it being possible for two adjacent radicals $R_1$ and $R_2$ together also to represent a benzo ring, a lower alkylene group or a 1,3-dioxapropylene group, B denotes cyano or a group of the formula $—COOR_{11}$ or $CONR_{11}R_{11}$, in which $R_{11}$ denotes hydrogen, $C_1$–$C_{18}$ alkyl, cycloalkyl, aryl, alkylaryl, halogenoaryl, aralkyl, alkoxyalkyl, halogenoalkyl, hydroxyalkyl, alkylaminoalkyl, carboxyalkyl or carboalkoxyalkyl, or two alkyl or alkylene radicals with the meaning of $R_{11}$ can also form, together with the nitrogen atom, a morpholine, piperidine or piperazine ring, or B denotes a group of the formula

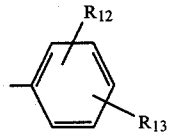

in which $R_{12}$ and $R_{13}$ denote identical or different radicals from the group comprising hydrogen, fluorine or chlorine atoms, phenyl, alkyl, alkoxy, acylamino, cyano, carboxyl, carbalkoxy, carboxamide, sulfonic acid, sulfonamide or sulfonic acid alkyl ester and two adjacent radicals $R_{12}$ and $R_{13}$ together can also represent an alkylene group, a fused benzo ring or a 1,3-dioxapropylene group, or B denotes a group of the formulae

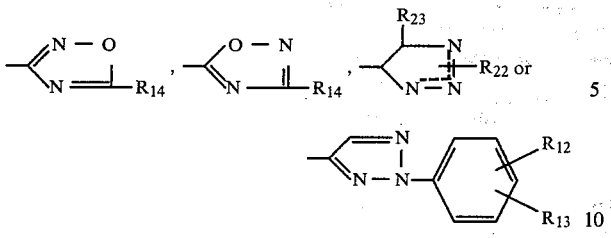

in which $R_{14}$ denotes a straight-chain or branched alkyl group having 1–18 C atoms and preferably 1–6 C atoms, which can be substituted by hydroxyl groups, halogen atoms or alkoxy, dialkylamino, alkylmercapto, chloroaryloxy, aryloxy, arylmercapto or aryl radicals, it being possible, in the case of the dialkylaminoalkyl groups, for the two alkyl groups together also to form a morpholine, piperidine or piperazine ring, or $R_{14}$ denotes a group of the formula $-(CH_2CH_2O)_n-R$ in which n is 1, 2 or 3 and R is H, alkyl, dialkylaminoalkoxyalkyl or alkylthioalkoxyalkyl, it being possible for the dialkyl groups in dialkylaminoalkoxyalkyl together to form a piperidine, pyrrolidine, hexamethyleneimine, morpholine or piperazine ring, or $R_{14}$ denotes a radical of the formula

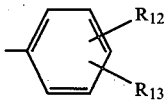

$R_{22}$ denotes a hydrogen atom, a triphenylmethyl group or a lower alkyl radical, which is optionally substituted by a lower carbalkoxy, carboxamide, mono- or di-alkylcarboxamido, carboxyl or benzoyl group, and $R_{23}$ denotes a cyano group or a group of the formulae

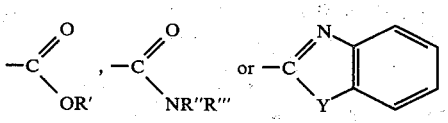

in which R', R'' and R''' denotes a hydrogen atom, a lower alkyl radical or a phenyl radical, and it being possible for the lower alkyl radicals to be substituted by hydroxyl, lower alkoxy, lower dialkylamino or lower trialkylammonium groups and for the phenyl group to be substituted by halogen atoms or lower alkyl or lower alkoxy groups, and in which R'' and R''' together can also form a saturated, divalent radical, and Y denotes O, S or N—R, in which R is H or ($C_1$ to $C_4$)-alkyl, or B denotes a group of the formula

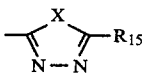

in which $R_{15}$ denotes a phenyl ring which can be substituted by one or two chlorine atoms, one or two alkyl or alkoxyalkyl groups or one phenyl, cyano, carboxyl, carbalkoxy, carboxamide, sulfonic acid, sulfonamide or sulfonic acid alkyl ester group, $R_3$ and $R_4$ can be identical or different and denote hydrogen, alkyl, cycloalkyl, alkoxy, hydroxyalkoxyethyl, halogenoalkyl, aralkyl, aryl or N,N-di-alkylamine, or $RO_3$ and $R_4$ together form a five-membered heterocyclic radical having 1 to 3 heteroatoms, preferably N atoms, $R_5$ denotes straight-chain or branched alkyl, alkoxyalkyl, dialkylaminoalkyl or a radical of the formula

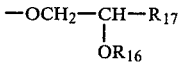

in which $R_{16}$ is hydrogen, $C_2$–$C_8$-alkanoyl, benzoyl or a radical of the formula $R_{18}NHCO-$ or $R_{19}O-CO-$ and $R_{17}$ is hydrogen, alkyl or phenyl, $R_{18}$ is alkyl, phenyl, halogenophenyl or tolyl and $R_{19}$ is $C_1$–$C_8$-alkyl, alkoxyalkyl, cyclohexyl, benzyl, phenylethyl or phenyl which is optionally substituted by non-chromophoric substituents, or $R_5$ denotes a radical of the formula

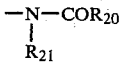

in which $R_{20}$ is $C_1$–$C_{10}$-alkyl, $C_2$–$C_6$-alkenyl, $C_2$–$C_6$-alkinyl, $C_1$–$C_8$-alkoxy, $C_1$–$C_8$-alkylamino or dialkylamino, phenoxymethyl, phenyl, tolyl, benzyl or phenylethyl and $R_{21}$ is $C_3$–$C_{10}$-alkyl, which can be substituted by phenyl, hydroxyphenyl, methoxy or dimethoxy, $R_6$ denotes an aryl radical, which is optionally substituted by non-chromophoric substituents, or denotes a 1,2,4-triazol-1-yl-phenyl, 1,2,3-triazol-4-yl-phenyl, 1,2,3-triazol-3-yl-phenyl or 1,2,3-triazol-2-yl-phenyl radical, which optionally can be substituted by 1 or 2 $C_1$–$C_3$-alkyl or oxalkyl groups or by oxaryl, oxalkenyl or oxalkanoyl, or $R_6$ denotes a heterocyclic ring having 1–3 heteroatoms, preferably N or O, which can be substituted by alkyl, alkoxy, halogen, aryl or halogenoaryl, or $R_6$ denotes a 1-oxa-2,4-diazol-5-yl radical, which can be substituted by benzyl, alkoxyphenyl, styryl, halogen, alkoxy or a further heterocyclic group, or $R_6$ denotes a benzimidazol-1-yl, benzimidazol-2-yl, benzthiazol-1-yl or benzthiazol-2-yl radical, which can be substituted by non-chromophoric substituents, $R_7$ denotes hydrogen, alkyl, alkoxy, aryl or a five-membered heterocyclic radical which has 1–3 N or O hetero-atoms and is bonded via a nitrogen atom and can be substituted by alkyl, aryl, hydroxyl, oxalkyl, oxalkenyl, oxaryl, oxarylalkyl, oxalkoxycarbonyl, oxcarbamoyl, oxepoxyalkyl, styryl or halogenostyryl, a fused phenyl, naphthyl or phenanthryl ring or a fused group of the formulae

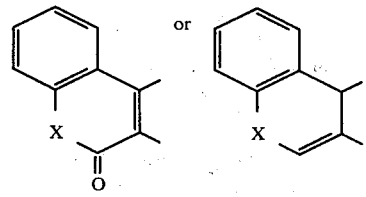

and the aromatic rings in the fused groups can also be substituted by alkyl or alkoxy and X is oxygen, NH or N-alkyl, $R_8$ represents a polycyclic, aromatic radical having at least three fused rings, which optionally carry non-chromophoric substituents, $R_9$ represents an amino group, which is substituted by one or two alkyl, hydroxyalkyl, acyl or phenyl groups, it being possible for the phenyl group to contain one or more non-chromophoric radicals and for two alkyl groups, together with the nitrogen atom of the amino group, to form a pyrrolidine or piperidine ring or, with the inclusion of a further nitrogen or oxygen atom, a piperazine or morpholine ring, or $R_9$ represents an alkoxy, hydroxyalkoxy, acyloxy, alkylthio or carbalkylmercapto group, $R_{10}$ independently of $R_8$ has the meaning as $R_9$ and in addition can denote a chlorine atom and V denotes a group of the formulae

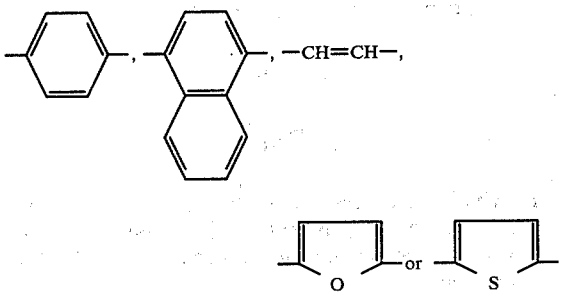

2. Mixtures of optical brighteners according to claim 1, in which component (A) consists of 5 to 35% by weight of compound (1), 30 to 90% by weight of compound (2) and 5 to 35% by weight of compound (3).

3. Mixtures of optical brighteners according to claim 1, in which component (A) consists of 15 to 28% by weight of compound (1), 44 to 70% by weight of compound (2) and 15 to 28% by weight of compound (3).

4. Mixtures of optical brighteners according to claim 1, in which component (B) consists of one or more compounds of the formulae 4a to 8a

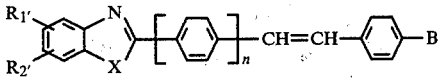

in which $R_{1'}$ and $R_{2'}$ in the 5-position and 7-position denote hydrogen or chlorine, alkyl or phenyl or together denote a fused phenyl ring, X denotes oxygen or sulfur, n denotes 1 and B denotes a group of the formulae

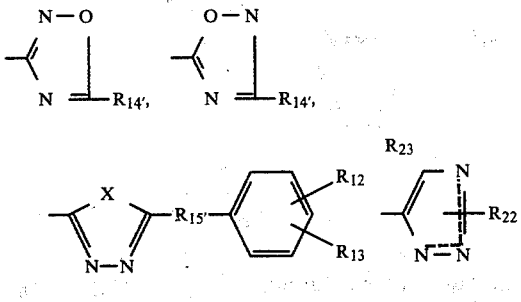

-continued

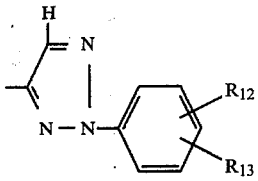

in which $R_{14'}$ denotes alkyl, chloroalkyl, alkoxyalkyl, hydroxyalkyl or a group of the formula $-(CH_2CH_2O)_n-R$, in which n is 2 or 3 and R is hydrogen or alkyl, $R_{15}$ denotes phenyl, which can be substituted by one or two chlorine atoms, one or two alkyl or alkoxyalkyl groups or one phenyl, cyano, carboxylic acid, carbalkoxy, carboxamide, sulfonic acid, sulfonamide or sulfonic acid alkyl ester group, $R_{23}$ denotes cyano or carbalkoxy and $R_{22}$ denotes alkyl,

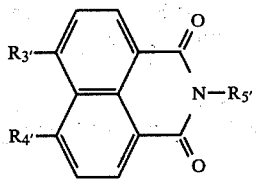

in which $R_{3'}$ denotes hydrogen or alkoxy, $R_{4'}$ denotes alkoxy and $R_{5'}$ denotes alkyl, alkoxyalkyl or dialkylaminoalkyl,

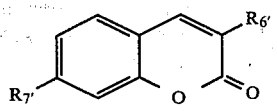

in which $R_{6'}$ denotes phenyl or the group of the formula

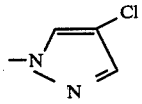

and $R_{7'}$ denotes the groups of the formulae

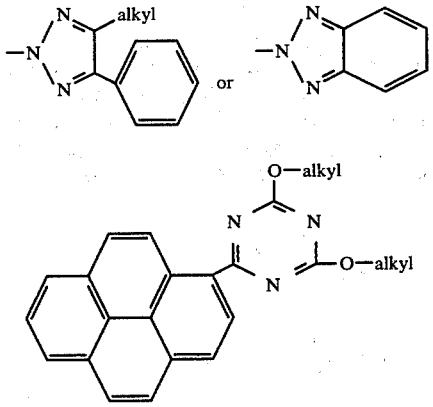

-continued

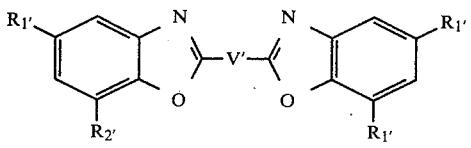

in which $R_{1'}$ and $R_{2'}$ denote hydrogen or alkyl and V' denotes a group of the formulae

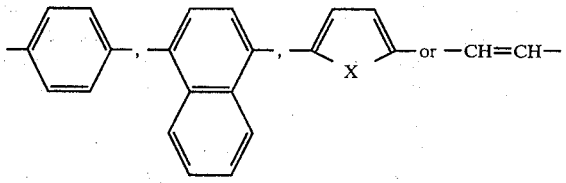

and X denotes O or S.

5. Mixtures of optical brighteners according to claim 2, in which component B consists of one or more compounds of the formulae 2b–6b

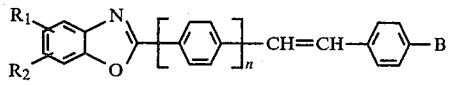

(2b)

in which $R_1$ in the 5-position denotes a hydrogen or chlorine atom or a methyl or phenyl group and $R_2$ denotes a hydrogen atom, or $R_1$ and $R_2$ both denote a methyl group a hydrogen atom, or $R_1$ and $R_2$ both denote a methyl group in the 5,6- or 5,7-position, n denotes 0 or 1 and B denotes a cyano or carbo-($C_1$–$C_4$)-alkoxy group or a group of the formulae

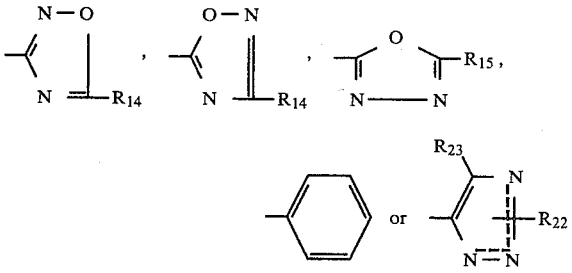

in which $R_{14}$ denotes ($C_1$–$C_6$)-alkyl, ($C_1$–$C_6$)-chloroalkyl, ($C_1$–$C_4$)-alkoxy-($C_1$–$C_4$)-alkyl, hydroxy-($C_1$–$C_4$)-alkyl or a group of the formula —$(CH_2CH_2O)_n$—R, n denotes 2 or 3 and R denotes hydrogen or ($C_1$–$C_4$)-alkyl, $R_{15}$ denotes phenyl, halogenophenyl, ($C_1$–$C_4$)-alkylphenyl or ($C_1$–$C_4$)-alkoxyphenyl, $R_{22}$ denotes ($C_1$–$C_4$)-alkyl and $R_{23}$ denotes cyano or carbo-($C_1$–$C_4$)-alkoxy,

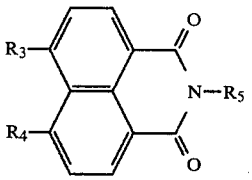

(3b)

in which $R_3$ denotes hydrogen or ($C_1$–$C_4$)-alkoxy, $R_4$ denotes ($C_1$–$C_4$)-alkoxy and $R_5$ denotes ($C_1$–$C_6$)-alkyl or ($C_1$–$C_4$)-alkoxy-($C_1$–$C_4$)-alkyl,

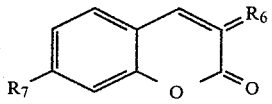

(4b)

in which $R_6$ denotes phenyl or the group of the formulae

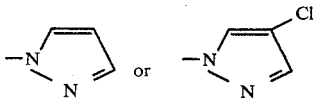

and $R_7$ denotes a group of the formula

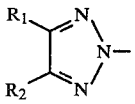

in which $R_1$ represents hydrogen or ($C_1$–$C_4$)-alkyl and $R_2$ represents phenyl or ($C_1$–$C_4$)-alkoxy, or $R_1$ and $R_2$ together represent a benzo or (1,2-d)-naphtho ring,

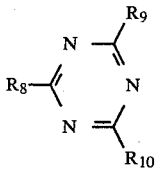

(5b)

in which $R_8$ denotes a pyrenyl group and $R_9$ and $R_{10}$ denote ($C_1$–$C_4$)-alkoxy, and

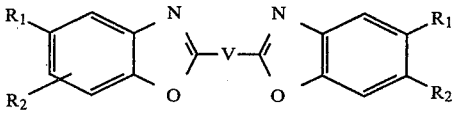

(6b)

in which $R_1$ and $R_2$ have the same meaning as in formula 2b and V denotes a group of the formulae

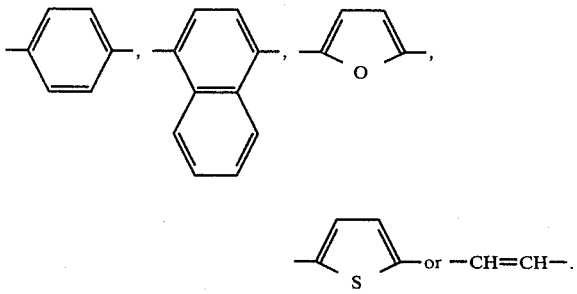

6. Mixtures of optical brighteners according to claim 1, in which component B consists of one or more compounds of the following formulae

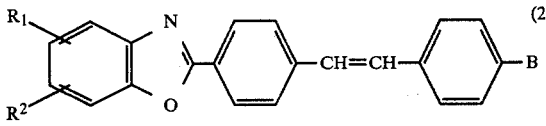

(2c)

in which $R_1$ and $R_2$ in the 5,6-position are methyl and B is carbomethoxy, or $R_1$ is hydrogen, $R_2$ is hydrogen or methyl in the 5-position and B is carbomethoxy, cyano or a group of the formulae

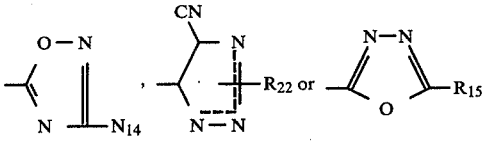

in which $R_{14}$ and $R_{22}$ are ($C_1$–$C_3$)-alkyl and $R_{15}$ is phenyl, 4-methylphenyl or 4-methoxyphenyl, or $R_1$ is hydrogen, methyl or t-butyl in the 5-position, $R_2$ is hydrogen or methyl in the 7-position and B is phenyl,

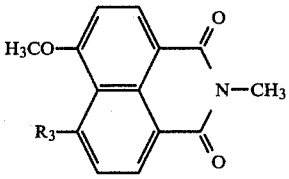

(3c)

in which $R_3$ is hydrogen or methoxy,

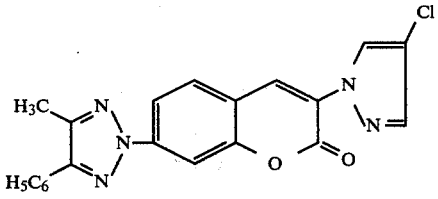

(4c)

-continued

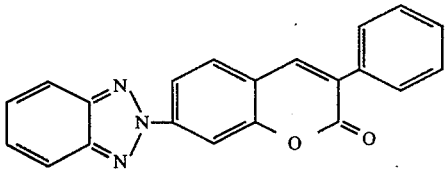

or

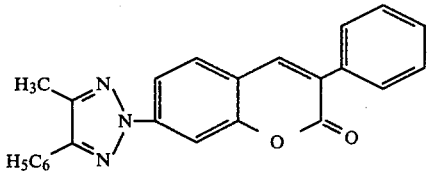

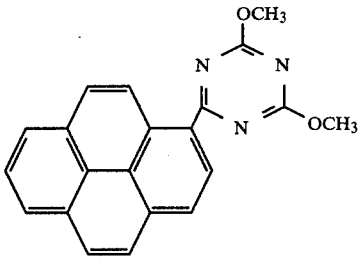

(5c)

and

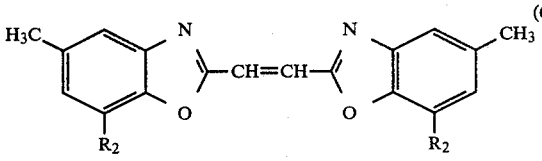

(6c)

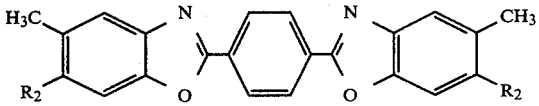

or

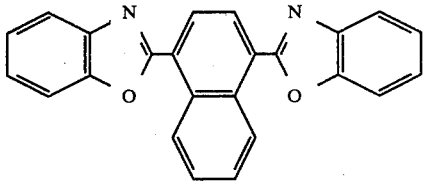

in which $R_2$ is hydrogen or methyl.

7. Mixtures of optical brighteners according to claim 1, consisting of 5 to 50% by weight of component A and 95 to 50% by weight of component B.

* * * * *